United States Patent [19]

Rutledge

[11] Patent Number: 5,043,853

[45] Date of Patent: Aug. 27, 1991

[54] FIELD REPAIRABLE EXPLOSION-PROOF FLUORESCENT FIXTURE

[75] Inventor: George Rutledge, Pontotoc, Miss.

[73] Assignee: Emerson Electric Co., St. Louis, Mo.

[21] Appl. No.: 620,906

[22] Filed: Dec. 3, 1990

[51] Int. Cl.[5] ..... F21V 17/00

[52] U.S. Cl. ..... 362/222; 362/221; 362/376

[58] Field of Search ..... 362/217, 221, 222, 223, 362/260, 267, 376

[56] References Cited

U.S. PATENT DOCUMENTS 2,392,202 1/1946 Tornblom ..... 362/222
2,874,270 2/1959 Douglass et al. ..... 362/222
4,841,418 6/1989 Davis ..... 362/223

*Primary Examiner*—Stephen F. Husar
*Attorney, Agent, or Firm*—Polster, Polster and Lucchesi

[57] ABSTRACT

An explosion proof fluorescent lamp fixture includes a pair of end housings having aligned openings which removably receive transparent lamp sleeves and a ballast housing. The lamp sleeves are fixed in first annular rings which matingly connect to second annular rings to form labyrinth seals. The second annular rings are removably inserted in the end housing openings. Thus, the fluorescent lamp is easily field reparable. A method of mounting a ballast in the ballast housing is also disclosed.

21 Claims, 2 Drawing Sheets

FIELD REPAIRABLE EXPLOSION-PROOF FLUORESCENT FIXTURE

BACKGROUND OF THE INVENTION

Four-lamp explosion-proof fluorescent fixtures presently in common use have four transparent glass sleeves, each of which surrounds one fluorescent lamp. Each sleeve is conventionally flared at both ends, and rests against a shoulder integral with a wall of an end housing at each end of the fixture. This sleeve is cemented into an aperture inboard of the shoulder in the long dimension of the fixture, while the unconnected end housings are held in a jig or fixture, and a ballast housing is fastened to and between the two end housings after the sleeves have been cemented. Although such conventional fixtures can be relamped through the open ends of the sleeves, if one of the sleeves must be replaced, all of the sleeves have to be broken. The conventional explosion-proof fluorescent fixtures use a standard forty-eight inch tube, which makes the lamp fixtures about fifty-two inches overall in length.

This problem was addressed in co-assigned U.S. Pat. No. 4,841,418 to Davis. Davis included openings in end housings through which the sleeve can pass. The sleeve, however, was cemented to the end housing. The fixture disclosed therein allowed for replacing individual sleeves without breaking all the sleeves. However, to do so required chipping out the cement. This is a time-consuming procedure. Further, it risks accidental breaking of a sleeve while chipping out cement.

One of the objects of this invention is to provide an explosion-proof fluorescent fixture in which the lamp tubes may be easily replaced.

Another object is to provide such a fixture wherein ballast may be removed and replaced without disassembling the ballast housing.

Another object is to provide such a fixture wherein an explosion proof integrity is maintained when lamp tubes and ballasts are removed and replaced.

These and other objects will become apparent to those skilled in the art in light of the following disclosure and accompanying drawings.

SUMMARY OF THE INVENTION

In accordance with this invention, generally stated, in an explosion-proof fluorescent fixture having an end housing including inner and outer walls, and an opening in the inner and outer walls, and a light transmitting sleeve mounted in the inner wall opening. Ring means are provided for removably mounting the light transmitting sleeve in the inner wall opening. The ring means includes a first and a second annular ring. The first annular ring has a peripheral inboardly directed annular flange in which the light transmitting sleeve is fixed, and spaced-apart, outboardly directed concentric ribs. The second annular ring, which is removably secured in the inner wall, has inboardly directed concentric ribs which matingly cooperate with the ribs of the first annular ring. The ribs form a labyrinth seal when the annular rings are connected.

The outer wall opening is closed with a cover.

The end housing further includes an opening in the inner wall which receives a ballast housing and an opening in the outer wall which allows access to the ballast housing. The ballast housing has an inner surface defining a chamber for receiving a ballast and means for securing the ballast in the chamber. In a preferred embodiment, the ballast includes an outboardly directed flange having screw holes therethrough. The flange is bent to be adjacent boss means to secure the ballast in the ballast housing. The ballast securing means also includes a hold down bracket having a first leg positioned intermediate a side wall of the ballast and the inner surface, and a second leg which extends above the ballast to be received in a groove in the inner surface.

In a second embodiment of the ballast housing, the inner surface includes an upwardly directed tongue. The ballast securing means includes a bracket which cooperates with the tongue and a plate fixed to the bracket to which the ballast is secured.

In another embodiment of the ballast housing, the inner surface includes boss means. The ballast securing means includes a plate to which the ballast is secured having a tab which overlies the boss means and fastening means for securing the plate to said boss via said tab.

A method for assembling an explosion-proof fluorescent fixture is also disclosed.

DESCRIPTION OF THE PREFERRED EMBODIMENT

Figure 1:
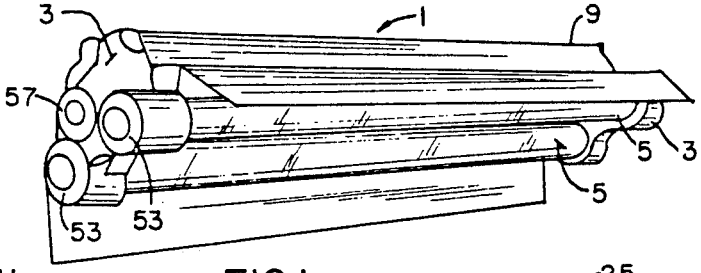
FIG. 1 is a perspective view of a fluorescent lamp fixture.

Referring to FIG. 1, a fluorescent lamp fixture 1 includes a pair of end housings 3 which bracket transparent lamp sleeves 5 and a ballast housing 7, shown particularly in FIGS. 4–7. Lamp sleeves 5 house fluorescent lamps. A hood 9 extends between end housings 3.

End housings 3 each include an outer wall 11 and an inner wall 13 defining between them, a chamber 15. The outer and inner walls, 11 and 13, have a pair of aligned threaded apertures 17 and 19 which receive lamp sleeves 5, and apertures 21 and 23, shown particularly in FIG. 7, which receive the ballast housing 7.

Figure 2:
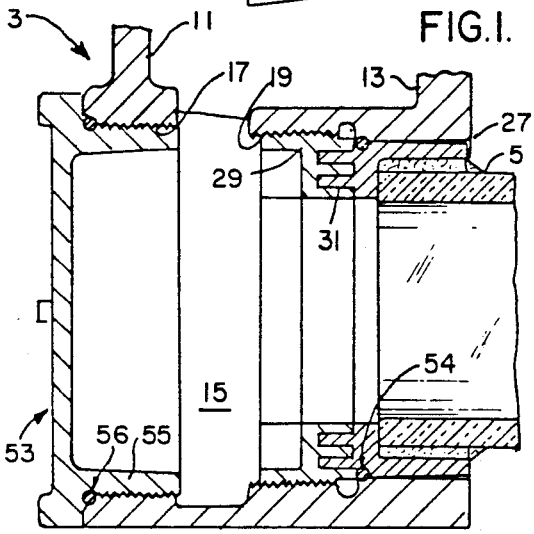
FIG. 2 is a fragmentary, cross-sectional view of an end housing showing the manner in which a lamp sleeve is removably secured to the housing.
Figure 3:
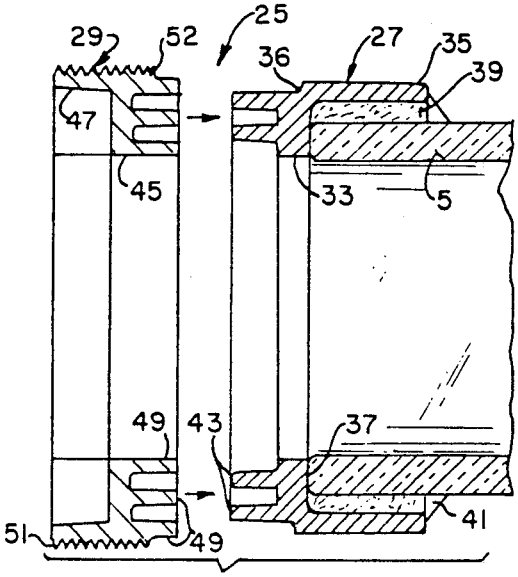
FIG. 3 is a cross-sectional, fragmentary, exploded view of a ring assembly used to secure the lamp sleeve to the end housing.

Turning to FIGS. 2 and 3, the lamp sleeves 5 are removably secured to end housings 3 by a ring assembly 25 which is received in inner wall aperture 19. Ring assembly 25 comprises an inner ring 27 which receives lamp sleeve 5 and an externally threaded outer ring 29 which is threadedly received in aperture 19. The two rings are joined by a labyrinth seal 31. The inner ring 27 has a base portion 33, an inboardly extending annular lip 35, and a pair of outboardly directed concentric annular ribs 43. Annular lip 35 is narrower than base portion 33 and forms a seat 37 therewith. Lip 35 also extends slightly above base portion 33 to form an external seat 36. Annular lip 35 receives lamp sleeve 5 so that sleeve 5 butts up against seat 37. Lamp sleeve 5 is secured within lip 5, such as with cement 39. The cement is sealed from the atmosphere as at 41.

The outer ring 29 is similar in structure to the inner ring 27. It includes a base portion 45 having an outboardly extending, annular lip 47 and concentric annular ribs 49. The outer ring 29 is externally threaded as at 51. The threads 51 extend from the outer end of lip 47 to a point approximately half way along the length of ribs 49 and form an external seat 52.

Inner ring ribs 43 and outer ring ribs 49 are shaped and positioned so that they cooperate with each other to form the labyrinth seal 31. The labyrinth seal as shown, provides a flame path that is a sufficiently long to vent the pressure caused by an internal explosion. The labyrinth seal is not limited to the structure shown, but may have more or fewer ribs if desired.

When inner and outer rings 27 and 29 are joined, external seat 36 and the forward edge of the outermost rib 49 of outer ring 27 form a channel which receives an O-ring 54.

Figure 4:
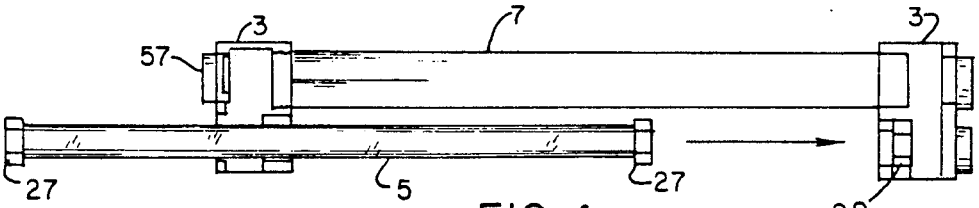
FIGS. 4–6 illustrate a method of removably mounting the lamp sleeve to the end housing.
Figure 5:
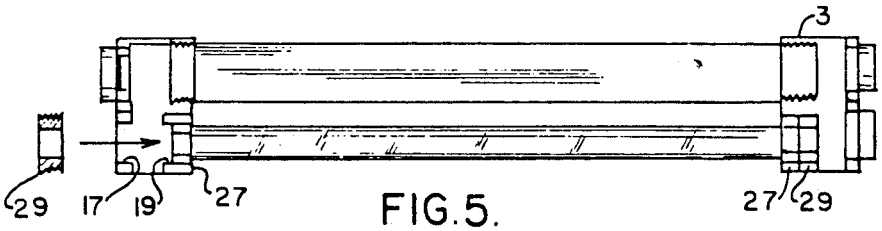
Figure 6:
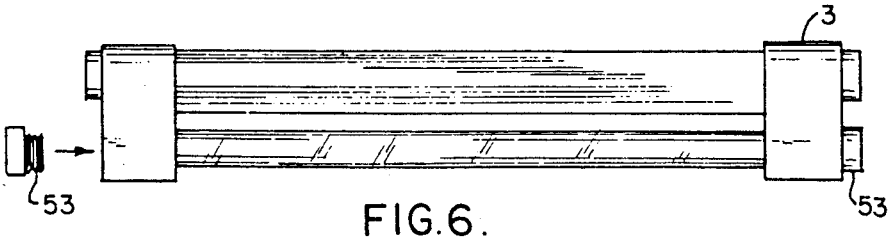

Turning to FIGS. 4–6, the lamp 1 is assembled by securing a first outer ring 29 in a first end housing 3. A lamp sleeve 5, both ends of which are cemented into inner rings 27, is passed through the apertures 17 and 19 of a second end housing 3 so that a first inner ring 27 will mate with the first outer ring 29 in the first end housing. A second outer ring 29 is then screwed into the second end housing to mate with the second inner ring 27 to secure lamp sleeve 5 between end housings 3. The outer wall apertures 17 may then be capped with covers 53 which have a threaded annular lip 55 which cooperates with the threads of aperture 17. An O-ring 56 is placed between cover 53 and end housing 3.

The lamp sleeve mounting method of the invention allows for quick and easy installation and field replacement of lamp tubes 5. Further as the lamp sleeve is not cemented directly to the end housing 3, the lamp sleeves are easily replaced. Because the lamps are accessible through covers 53, and because the labyrinth seal is easily reformed upon relamping and replacement of lamp sleeves, the fixture maintains its explosion-proof integrity.

Figure 8:
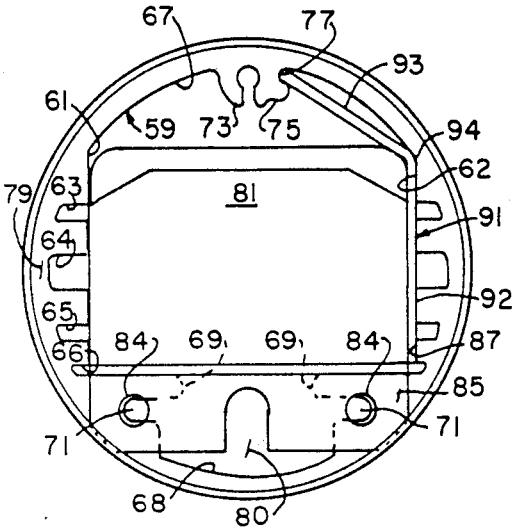
FIG. 8 is a front elevational view of the ballast housing of FIG. 7 with ballast secured therein.
Figure 7:
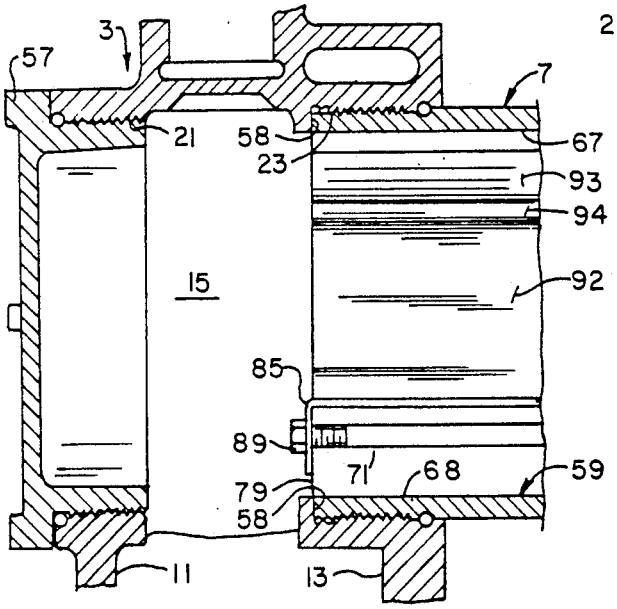
FIG. 7 is a fragmentary cross-sectional view showing a ballast housing secured to the end housing and carrying ballast.

Turning to FIGS. 7 and 8, the ballast housing 7 is externally threaded to be threadedly received in inner wall aperture 23. Ballast housing 7 butts against a seat 58 formed between opening 23 and chamber 15. The outer wall aperture 21 is capped with a threaded cover 57 similar to cover 53.

The inner surface 59 of ballast housing 7 has vertical side walls 61 and 62, an arcuate top 67, and an arcuate bottom 68 Side walls 61 and 62 each have parallel slots 63–66 therein. Wall slot 64 is centered with respect to the height of the wall, slots 63 and 65 are spaced equidistantly from slot 64, on opposite sides thereof, and slot 66 is spaced below slot 65. A ledge 69 is formed at the bottom of side walls 61 and 62, the top edge of which is co-planar with the bottom edge of slots 66. Beneath each ledge 69 is a screw boss 71. The top wall 67 includes a grooved rib 73 having a finger 75 extending therefrom which forms a groove 77 therewith. As seen in FIG. 7, the front face 79 of the inner surface 59 is generally planar. Ballast housing 7 is preferably formed by extrusion.

The inner surfaces define a chamber 80 which receives a ballast 81. The ballast 81 includes an outboardly directed flange 85 having screw holes 84 therethrough. Flange 85 is bent 90° so that screw holes 84 are adjacent screw bosses 71 in front face 79. Screws 89 are passed through screw holes 84 and into screw bosses 71 to secure ballast 81 in place. Ballast 81 is slightly smaller than the width of chamber 80 and is mounted therein so that it is adjacent wall 61 and spaced slightly from wall 62. Thus, there is a gap 87 between ballast 81 and side wall 62, as can more easily be seen in FIGS. 9 and 10.

A hold down bracket 91 having legs 92 and 93 which meet at an elbow 94 aids in securing ballast 8! in place. Hold down bracket leg 92 is slidably received in gap 87. The elbow 94 bends around the top of ballast 81 so that the end of leg 93 will be received in groove 77. This method of mounting ballast 81 in ballast housing 7 has been found to provide good means for heat sinking the ballast to the housing.

Figure 9:
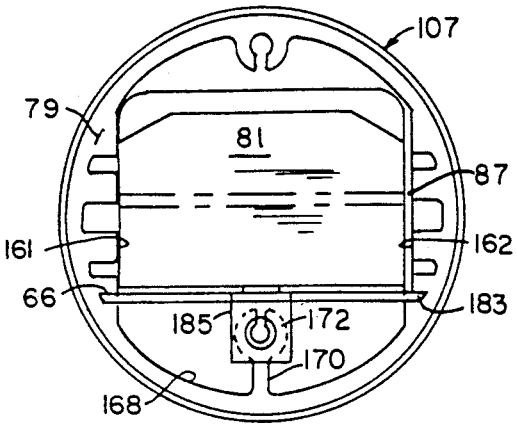
FIG. 9 is a front elevational view showing a second method of securing a ballast within a ballast housing.

FIG. 9 shows a first alternative method for mounting the ballast 81 within a ballast housing 107. Housing 107 is similar to housing 7, thus identical reference numerals will be used for identical features. Vertical walls 161 and 162 are identical to walls 61 and 62, however, they do not have ledges 69. Bottom wall 168 has an upwardly directed tongue 170 having a screw boss 172. Ballast 81 is secured to a plate 183 which is slidably received in slots 66. A tab 185 depends from plate 183 and covers screw boss 172. A screw hole in tab 185 allows for passage of a screw therethrough which is received in screw boss 172 to secure ballast 81 in housing 107. Ballast 81 is mounted to plate 183. Ballast is not mounted to plate in that embodiment.

Figure 10:
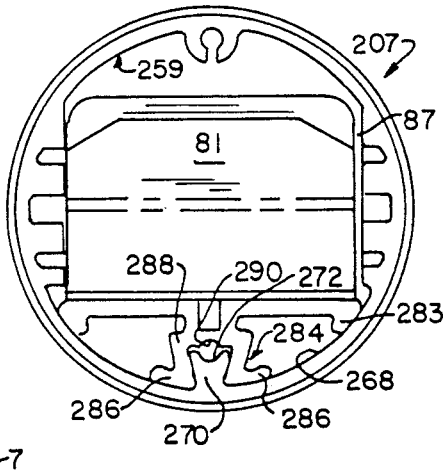
FIG. 10 is a front elevational view showing a third method of mounting a ballast in a ballast housing.

FIG. 10 shows a second alternative method for mounting ballast 81 within a housing 207. The bottom 268 of inner surface 259 includes a dovetailed tongue 270 in the center thereof. Tongue 270 includes a semicircular groove 272 in the center of the top thereof. Ballast 81 is mounted to a plate or extrusion 283 which includes a bracket portion 284 which cooperates with tongue 270. Bracket portion 284 includes a pair of legs 286 which are connected by a cross-bar 288. Cross-bar 288 includes a semi-circular groove 290 which is positioned above tongue groove 272. Grooves 272 and 290 form a screw boss which receives a screw to hold ballast 81 in place.

Numerous variations within the scope of the appended claims will be apparent to those skilled in the art in light of the foregoing description and accompanying drawings. For example, covers 53 and 57 may be force fitted, rather then screwed into apertures 17 and 21, respectively. The ring assembly 25 may alternatively include an externally threaded outer ring having an annular lip extending from its periphery and an inner ring which is received in the lip, wherein the external surface of the inner ring and the inner surface of the outer ring lip form the flame path to vent an internal explosion. These examples are merely illustrative.

Having thus described the invention, what is claimed and desired to be secured by Letters Patent is:

1. In an explosion-proof fluorescent fixture comprising an end housing having inner and outer walls, an opening in said inner and outer walls, a light transmitting sleeve having an open end and mounted in said inner wall opening; the improvement comprising ring means for removably mounting said light transmitting sleeve in said inner wall opening, said ring means comprising an inner ring in which said light transmitting sleeve is mounted, and an outer ring, coaxial with said inner ring, said inner and outer rings forming a seal, said rings being movable relative to one another.

2. The improvement of claim 1, wherein said inner ring is an annular ring having a peripheral inboardly directed annular flange in which said light transmitting sleeve is fixed, and spaced-apart, outboardly directed concentric ribs; and said outer ring is an annular ring which is removably secured in said inner wall, said second ring having inboardly directed concentric ribs which matingly cooperate with said ribs of said first annular ring.

3. The improvement of claim 2, wherein said ribs form a labyrinth seal when said annular rings are connected.

4. The improvement of claim 2, wherein said outer wall opening is closed with a cover, said cover being threadedly received in said opening.

5. The improvement of claim 1, wherein said end housing further includes an opening in said inner wall which receives a ballast housing and an opening in said outer wall which allows access to said ballast housing, said ballast housing having an inner surface defining a chamber for receiving a ballast and means for securing said ballast in said chamber.

6. The improvement of claim 5, wherein said ballast securing means includes an outboardly directed flange having screw holes therethrough, said ballast securing means comprising boss means in said inner surface, said flange being bent to be adjacent said boss means.

7. The improvement of claim 6, wherein said ballast securing means further includes a hold down bracket, said bracket having a first leg positioned intermediate a side wall of said ballast and said inner surface, and a second leg which extends above said ballast to be received in a groove in said inner surface.

8. The improvement of claim 5, wherein said inner surface includes an upwardly directed tongue, said ballast securing means comprising a bracket which cooperates with said tongue and a plate fixed to said bracket to which said ballast is secured.

9. The improvement of claim 5, wherein said inner surface includes boss means, said ballast securing means comprising a plate to which said ballast is secured having a tab which overlies said boss means and fastening means for securing said plate to said boss via said tab.

10. A method of assembling an explosion-proof fluorescent fixture comprising:

mounting a light transmitting sleeve in a ring assembly;

fixing said ring assembly in an opening of an end housing;

mounting a ballast in a ballast housing; and fixing said ballast housing in a second opening of said end housing.

11. The method of claim 10, wherein the step of mounting said light transmitting sleeve in said ring assembly comprises mounting said light-transmitting sleeve in a first annular ring; inserting said first annular ring and light transmitting sleeve in said end housing opening; and inserting a second annular ring in said opening to matingly connect to said first annular ring to secure said light transmitting sleeve in said end housing.

12. The method of claim 11, wherein the step of connecting said first and second annular rings creates a labyrinth seal between said rings.

13. An explosion-proof fluorescent fixture comprising an end housing having inner and outer walls, an opening in said inner and outer walls, and a ballast housing which is received in said inner wall opening, said outer wall opening allowing access to said ballast housing, said ballast housing having an inner surface defining a chamber for receiving a ballast and means for securing said ballast in said chamber.

14. The fluorescent fixture of claim 13, wherein said ballast includes a flange having screw holes therethrough, said ballast securing means comprising boss means in said inner surface, said flange being bent to be adjacent said boss means.

15. The fluorescent fixture of claim 14, wherein said ballast securing means further includes a hold down bracket, said bracket having a first leg positioned intermediate a side wall of said ballast and said inner surface, and a second leg which extends above said ballast to be received in a groove in said inner surface.

16. The fluorescent fixture of claim 13, wherein said inner surface includes an upwardly directed tongue, said ballast securing means comprising a bracket which cooperates with said tongue and a plate fixed to said bracket to which said ballast is secured.

17. The fluorescent fixture of claim 13, wherein said inner surface includes boss means, said ballast securing means comprising a plate to which said ballast is secured having a tab which overlies said boss means and fastening means for securing said plate to said boss via said tab.

18. A ballast housing which carries a ballast for a fluorescent lamp, said housing having inner and outer walls and means for securing said ballast therein, said inner wall having an arcuate top portion, an arcuate bottom portion, and vertical side portions defining a chamber for receiving said ballast; said ballast being mounted on a plate including an outboard flange having screw holes therethrough, said ballast securing means comprising boss means in said inner surface, said flange being bent to be adjacent said boss means.

19. The ballast housing of claim 18, wherein said ballast securing means further includes a hold down bracket, said bracket having a first leg positioned intermediate a side wall of said ballast and said inner surface, and a second leg which extends above said ballast to be received in a groove in said upper surface.

20. The ballast housing of claim 18, wherein said inner surface includes an upwardly directed tongue, said ballast securing means comprising a bracket which cooperates with said tongue and a plate fixed to said bracket to which said ballast is secured.

21. The ballast housing of claim 18, wherein said inner surface includes boss means, said ballast securing means comprising a plate to which said ballast is secured having a tab which overlies said boss means and fastening means for securing said plate to said boss via said tab.

* * * * *